US006991328B2

(12) United States Patent
Ishii

(10) Patent No.: US 6,991,328 B2
(45) Date of Patent: Jan. 31, 2006

(54) MEDIUM TRANSPORTING DEVICE AND RECORDING APPARATUS INCORPORATING THE SAME

(75) Inventor: Takayuki Ishii, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/882,689

(22) Filed: Jul. 2, 2004

(65) Prior Publication Data

US 2005/0083390 A1 Apr. 21, 2005

(30) Foreign Application Priority Data

Jul. 2, 2003 (JP) ..... P2003-190425
Jul. 1, 2004 (JP) ..... P2004-195837

(51) Int. Cl.
*B65H 5/06* (2006.01)

(52) U.S. Cl. ..... 347/104; 347/16; 400/637; 271/274; 492/16; 492/18; 492/49

(58) Field of Classification Search ..... 347/5, 347/16–17, 104; 400/636, 637; 271/272, 271/274; 492/16, 18, 49
See application file for complete search history.

(56) References Cited

U.S. PATENT DOCUMENTS 3,408,438 A * 10/1968 Reilly ..... 198/843
3,653,108 A * 4/1972 Maca et al. ..... 492/16
5,522,785 A * 6/1996 Kedl et al. ..... 492/21
6,264,193 B1 * 7/2001 Moeller ..... 271/220

FOREIGN PATENT DOCUMENTS

JP 5-221060 A 8/1993
JP 7-2387 A 1/1995
JP 2002-254740 A 9/2002

* cited by examiner

*Primary Examiner*—Andrew H. Hirshfeld
*Assistant Examiner*—Jill E. Culler
(74) *Attorney, Agent, or Firm*—Sughrue Mion, PLLC

(57) ABSTRACT

A follower roller is brought into press contact with a driving roller by a load having a predetermined value, thereby being rotated in accordance with a rotation of the driving roller to transport the medium clamped therebetween in a first direction. The follower roller includes a shaft portion and a roller body provided so as to surround the shaft portion. The follower roller is configured such that a value of a ratio f/F is not greater than 0.03. Here, F is a force transporting the medium in the first direction which is generated by the load, and f is a resistance force generated in a second direction opposite to the first direction by a friction loss of the shaft portion of the follower roller which is generated by the load.

5 Claims, 15 Drawing Sheets

MEDIUM TRANSPORTING DEVICE AND RECORDING APPARATUS INCORPORATING THE SAME

BACKGROUND OF THE INVENTION

The present invention relates to a medium transporting device for transporting a medium, and a recording apparatus incorporating such a medium transporting device.

Generally, in a large-size printer which is a well-known recording apparatus, a sheet feeding section for feeding a recording medium such as recording paper is disposed below a printer body. A recording section for recording information on the fed recording paper and a sheet ejecting section for ejecting the recording paper after recording are disposed above the printer body. When such a large-size printer, for example, an ink jet printer is used, a user places recording paper in the sheet feeding section so that a leading end portion of the recording paper is pulled out of the sheet feeding section. While the leading end portion of the recording paper is clamped between a feeding roller and a follower roller, the ink jet printer is activated.

As a result, the ink jet printer rotates the feeding roller to feed the recording paper to a nip portion between a transporting roller and a follower roller in the recording section through a transport guide member. Then, while a feeding roller is rotated to feed the recording paper onto a platen of the recording section, ink drops are jetted from nozzle orifices of recording heads of the recording section to record information on the recording paper. The feeding roller is further rotated to transport the recording paper to a nip portion between an ejection roller and a follower roller in the sheet ejecting section. Then, the ejection roller is rotated to eject the recording paper onto a tray (e.g. see Japanese Patent Publication No. 2002-254740A).

Each of the follower rollers provided in the ink jet printer is made of plastics. A metal shaft is inserted in each follower roller so that the follower roller rotates while sliding on the metal shaft. Accordingly, the friction coefficient between the follower roller and the shaft is relatively high, so that a large transport resistance is generated on the basis of a friction loss of the shaft caused by pressing force of the follower roller. For this reason, a slippage occurs when the recording paper is transported. Because the amount of the slippage varies according to the kind of the recording paper, it is difficult to correct the transporting amount while considering the slippage for all kinds of recording paper.

SUMMARY OF THE INVENTION

It is therefore an object of the invention is to provide a medium transporting device which can achieve constant and accurate transporting regardless of the kind of the medium, and a recording apparatus incorporating such a medium transporting device.

In order to achieve the object, according to the invention, there is provided a device for transporting a medium, comprising:

a driving roller; and a follower roller, brought into press contact with the driving roller by a load having a predetermined value, thereby being rotated in accordance with a rotation of the driving roller to transport the medium clamped therebetween in a first direction, the follower roller comprising a shaft portion and a roller body provided so as to surround the shaft portion, wherein the follower roller is configured such that a value of a ratio f/F is not greater than 0.03, where F is a force transporting the medium in the first direction which is generated by the load, and f is a resistance force generated in a second direction opposite to the first direction by a friction loss of the shaft portion of the follower roller which is generated by the load.

With this configuration, the resistance force f can be reduced. Accordingly, the slippage at the time of transporting the medium can be reduced, so that medium transporting accuracy can be improved.

Preferably, a ball bearing is disposed between the shaft portion and the roller body.

With this configuration, the friction coefficient between the follower roller and the shaft portion can be reduced. Accordingly, the resistance force f which has a large influence on occurrence of the slippage at the time of transporting the medium can be also reduced.

Preferably, the value of the ratio f/F is determined by adjusting a ratio d/D, where d is an outer diameter of the shaft portion and D is an outer diameter of the follower roller.

In this case, when the ratio d/D of the outer diameter d of the shaft of the follower roller to the outer diameter D of the follower roller is set to be smaller, medium transport resistance f which has a large influence on occurrence of the slippage at the time of transporting the medium can be also reduced.

Preferably, the value of the load is determined so as to reduce a decrease of a transporting amount of the medium due to fluctuation of the load.

With this configuration, the slippage at the time of transporting the medium can be reduced more greatly regardless of the kind of the medium. Accordingly, medium transporting accuracy can be improved more greatly.

According to the invention, there is also provided a recording apparatus, comprising:

the above medium transporting device; and a recording section which performs a recording operation with respect to the medium transported by the medium transporting device.

DETAILED DESCRIPTION OF THE INVENTION

Embodiment of the present invention will be described below in detail with reference to the drawings.

Figure 1:
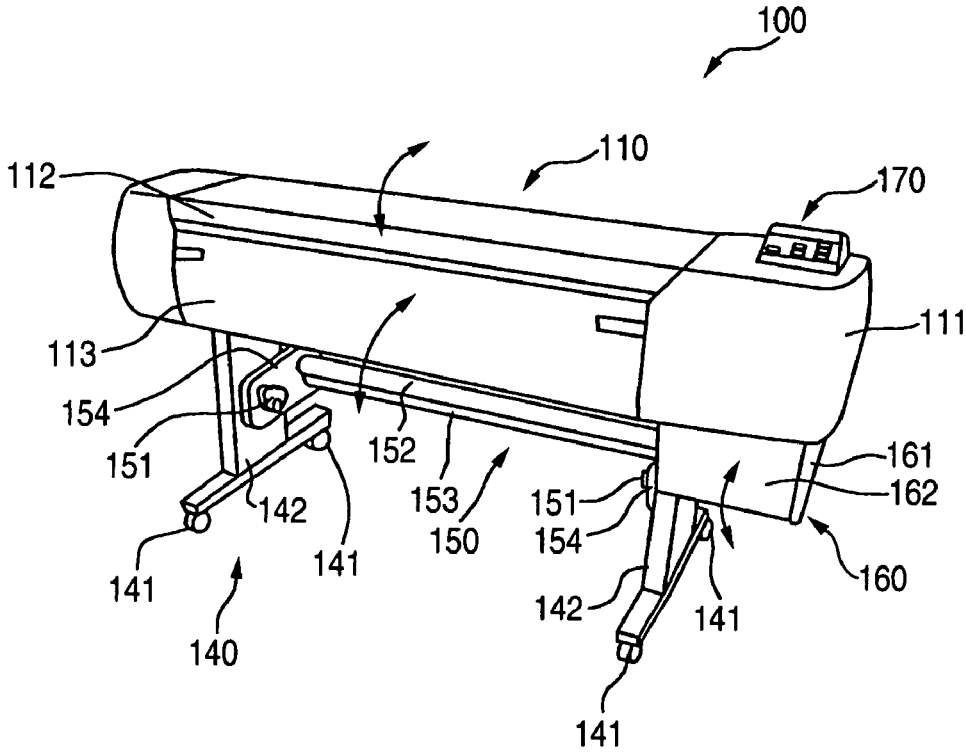
FIG. 1 is a perspective view showing a configuration example of an ink jet printer which is a recording apparatus incorporating a recoding recording medium cutting device of the invention.
Figure 2:
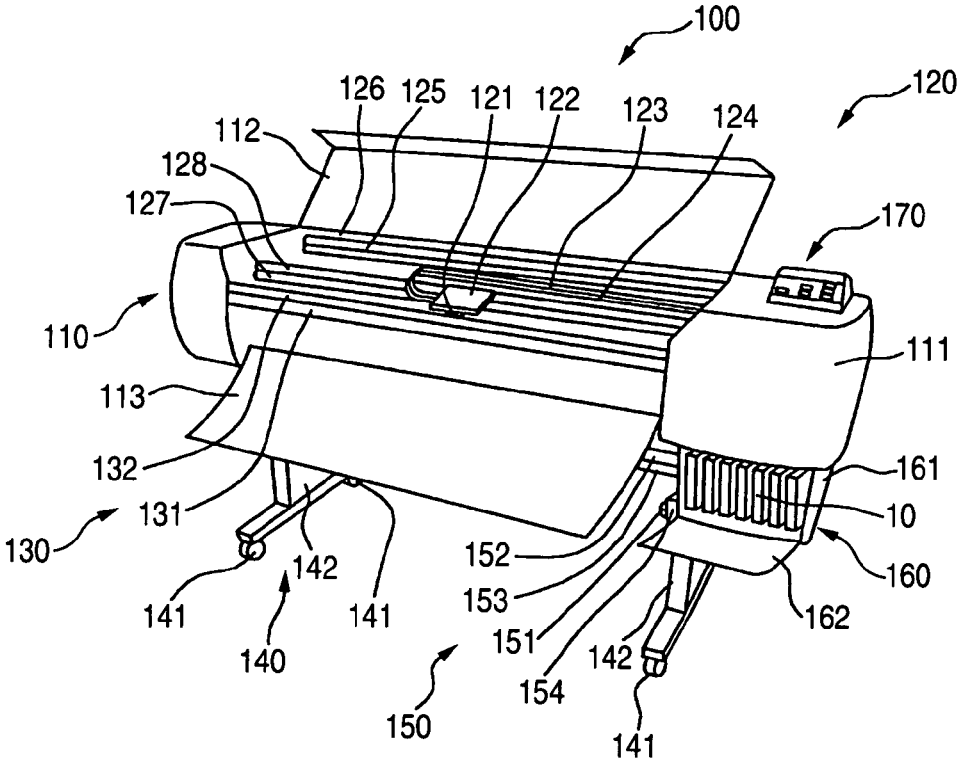
FIG. 2 is a perspective view showing an example of internal configuration of an essential part of the printer of FIG. 1.
Figure 3:
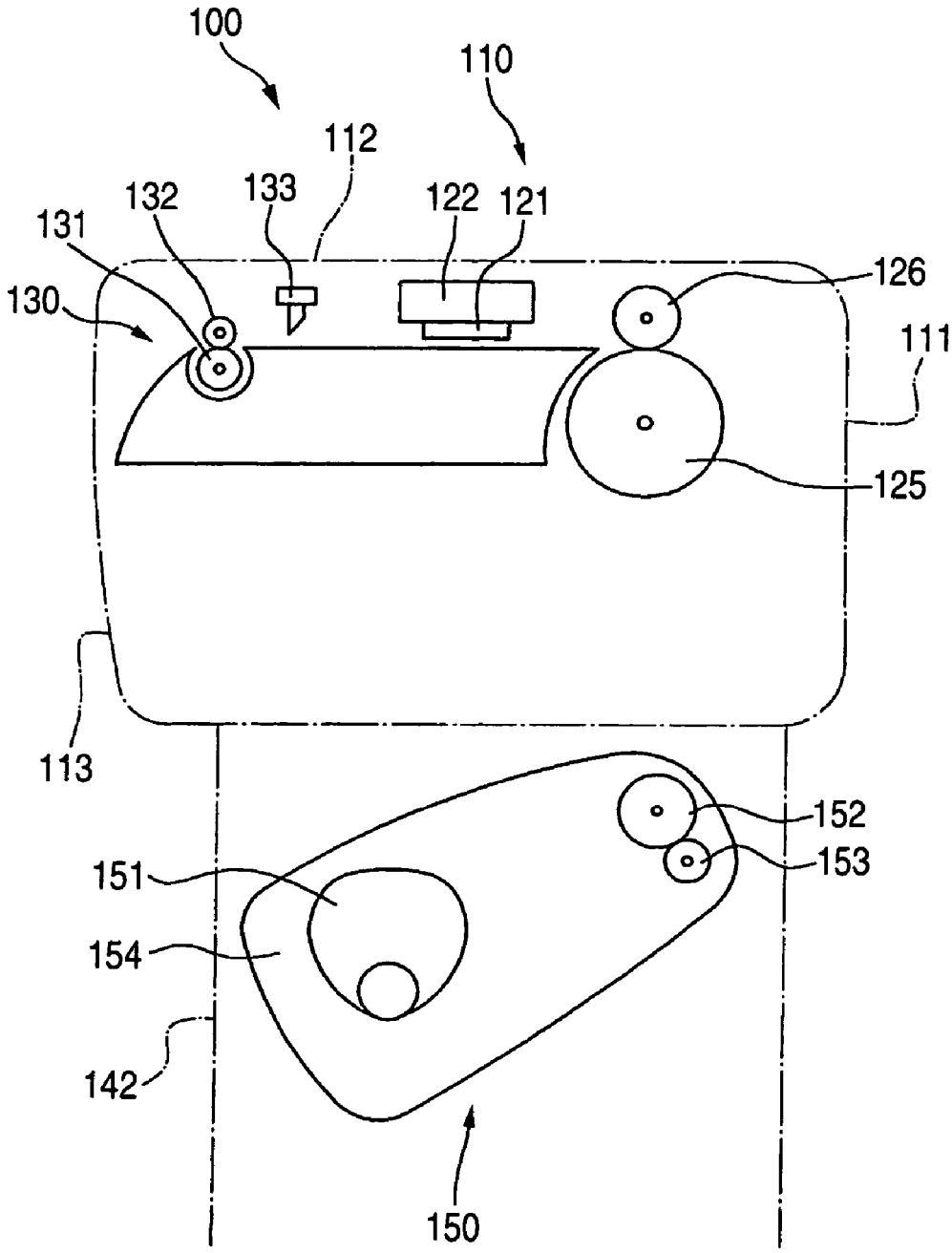
FIG. 3 is a sectional view of essential part of the printer of FIG. 1.

An ink jet printer 100 shown in FIGS. 1 to 3 is a large-size printer which can record an image on a rolled sheet having a relatively large width such as A1-size sheet or B1-size sheet according to Japanese Industrial Standards (JIS). The ink jet printer 100 includes a body section 110, a recording section 120, a sheet ejecting section 130, leg sections 140, and a sheet feeding section 150. The recording section 120, the sheet ejecting section 130 and a cutter 133 are disposed in the body section 110 of the ink jet printer 100. The sheet feeding section 150 is disposed between the leg sections 140 which support the body section 110.

As shown in FIGS. 1 to 3, the body section 110 includes a housing 111 which is made of a plastic or metal plate and with which the recording section 120 and the sheet ejecting section 130 are covered. As shown in FIGS. 1 to 3, the housing 111 is provided with upper and front covers 112 and 113 which are made of semitransparent or transparent plastic or metal plates respectively and which are provided so that upper and front parts of the housing 11 can be opened.

As shown in FIGS. 1 to 3, the upper cover 112 is pivoted on its rear portion so that the upper cover 112 can be opened or closed when a user pushes up or down the upper cover 112 while gripping a front portion of the upper cover 112. Because the recording section 120 and the sheet ejecting section 130 can be made open upward largely when the upper cover 112 is opened by the user, the maintenance of recording heads 121, a carriage 122, etc. and the removal of sheet transporting error such as a sheet jam during recording or sheet ejection can be made easily.

As shown in FIGS. 1 to 3, the front cover 113 is pivoted on its lower portion so that the front cover 113 can be opened or closed when the user pushed down or up the front cover 113 while gripping an upper portion of the front cover 113. Because the lower parts of the recording section 120 and the sheet ejecting section 130 can be made open largely when the front cover 113 is opened by the user, the removal of sheet transporting error such as a sheet jam during sheet feeding can be made easily.

As shown in FIGS. 1 and 2, an ink cartridge holder 160 is disposed in the lower right section of the body section 110 when viewed from the front. The ink cartridge holder 160 has a holder body 161 for receiving and holding respective color ink cartridges 10, and a cover 162 with which the front of the holder body 161 is covered. The cover 162 is pivoted on its lower portion so that the cover 162 can pivot relative to the holder body 161. That is, the cover 162 can be opened or closed when the user pushes down or up the cover 162 while gripping an upper portion of the cover 162. Because the holder body 161 can be made open largely when the cover 162 is opened by the user, the ink cartridges 10 can be replaced easily.

As shown in FIGS. 1 and 2, a control panel 170 operated by the user for recording control etc. is disposed in the upper right section of the body section 110 when viewed from the front. A liquid crystal display and various kinds of buttons are disposed in the control panel 170 so that the user can operate the buttons while watching the liquid crystal display for confirmation. Because the user can operate the buttons reliably on the basis of visibility, operation errors, operating mistakes, etc. can be eliminated.

As shown in FIGS. 2 and 3, the recording section 120 comprises: a carriage 122 which carries recording heads 121; a flexible flat cable (hereinafter referred to as FFC) 123 which electrically connects the recording heads 121 to a controller 101 for executing recording; ink tubes 124 which connect the recording heads 121 to the ink cartridges 10 each containing ink; a feeding roller 125 which transports the rolled sheet; a follower roller 126 which is driven by the feeding roller 125; and a not-shown sheet suction unit for preventing the transported rolled sheet from being floated up.

The recording heads 121 include a black ink recording head for jetting black ink, and a plurality of color ink recording heads for jetting various colors of ink such as dark yellow, yellow, light cyan, cyan, light magenta, magenta, etc. Pressure generating chambers and nozzle orifices respectively communicated with the pressure generating chambers are provided in the recording heads 121. When each pressure generating chamber is pressurized with a predetermined value in the condition that ink is reserved in the pressure generating chamber, an ink drop having a controlled size is jetted from a corresponding nozzle orifice toward the rolled sheet R.

As shown in FIG. 2, the carriage 122 is placed on a rail 127 through bearings and connected to a carriage belt 128. The rail 127 is provided in a primary scanning direction. When the carriage belt 128 is operated by a carriage actuator not shown, the carriage 122 makes a reciprocating motion while guided by the rail 127 in accordance with the movement of the carriage belt 128. The FFC 123 has one end connected to a connector of the controller 101, and the other end connected to a connector of the recording heads 121 so that a recording signal can be sent from the controller 101 to the recording heads 121.

The ink tubes 124 are provided for the various colors of ink. Each ink tube 124 has one end connected to a corresponding color ink cartridge 10 by way of a compressor not shown, and the other end connected to a corresponding color recording head 121. Each ink tube 124 is provided so that a corresponding color of ink pressurized by the compressor is fed from a corresponding ink cartridge 10 to a corresponding recording head 121.

The feeding roller 125 is driven to rotate forward and backward by driving force transmitted from a motor not shown. The follower roller 126 is pressed against the feeding roller 125 by an urging member such as a spring. The follower roller 126 follows the feeding roller 125 so that the follower roller 126 can rotate forward/backward with the forward/backward rotation of the feeding roller 125. The feeding roller 125 and the follower roller 126 feed the supplied rolled sheet while the rolled sheet is held between the feeding roller 125 and the follower roller 126.

Figure 4A:
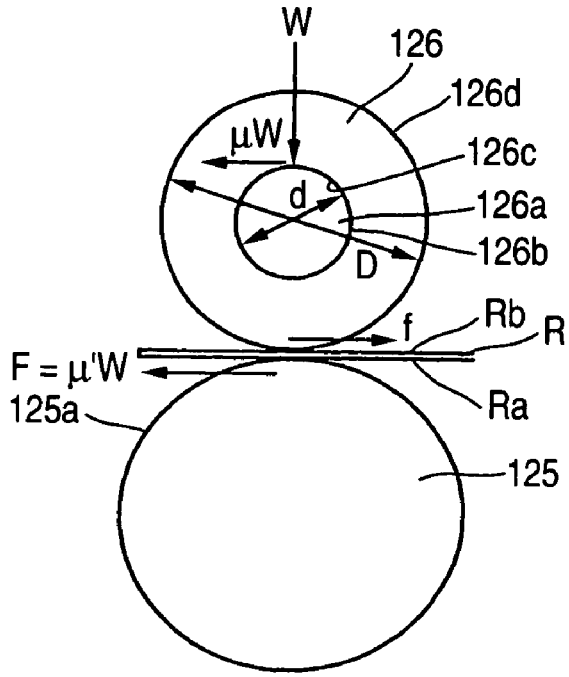
FIG. 4A is a schematic side view showing a state in which a rolled sheet is clamped between a feeding roller and a follower roller in the printer of FIG. 1 while the follower roller is pressed against the feeding roller.

Assume the case where the follower roller 126 is pressed against the feeding roller 125 by a load W in the condition that the rolled sheet R is put between the feeding roller 125 and the follower roller 126 as shown in FIG. 4A. When the feeding roller 125 in this state is rotated, a transporting force (medium feeding force) F, which is equal to the product $\mu'W$ of the friction coefficient $\mu'$ between a back surface Ra of the rolled sheet R and an outer circumferential face 125*a* of the feeding roller 125 and the load W, acts on the rolled sheet R.

On this occasion, a friction loss, which is equal to the product $\mu W$ of the friction coefficient $\mu$ between an outer circumferential face 126*b* of a shaft 126*a* of the follower roller 126 and an inner circumferential face 126*c* (or a bearing portion of the shaft 126*a*) of the follower roller 126 rotationally sliding on the shaft 126*a* and the load W, also acts on the follower roller 126. As a result, a transport resistance (medium feeding resistance) f acts on an obverse surface Rb of the rolled sheet R through an outer circumferential face 126*d* of the follower roller 126 in accordance with the friction loss $\mu W$. The transport resistance f is given by the following expression (1):

$$f = \frac{d/2}{D/2}\mu W = \frac{d}{D}\mu W \tag{1}$$

in which D is the outer diameter of the follower roller 126, and d is the outer diameter of the shaft 126*a*.

That is, the feeding roller 125 is betrayed by the follower roller 126 which must cooperate with the feeding roller 125, so that the feeding roller 125 suffers the resistance force from the nearest position. The transport resistance f has a large influence on transporting accuracy so that a large slippage may occur in accordance with the kind of the rolled sheet R. To solve this problem, it is necessary to reduce the ratio f/F of transport resistance f to transporting force F as given by the following expression (2):

$$\frac{f}{F} = \frac{(d/W)\mu W}{\mu' W} = \frac{d}{D}\frac{\mu}{\mu'} \tag{2}$$

Figure 5A:
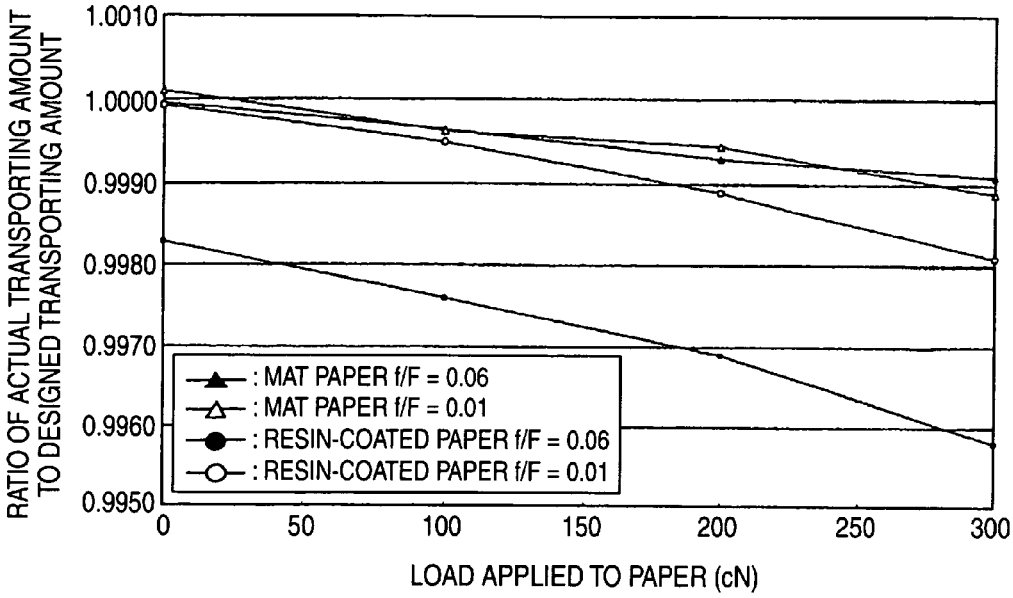
FIG. 5A is a graph showing a relation between loads imposed on the rolled sheet and transporting accuracies, for various kinds of rolled sheets.

FIG. 5A is a graph showing a relation between ratios of an actual transporting amount to a designed transporting amount (i.e. transporting accuracies) and loads (back tensions) imposed on the rolled sheet R, for various kinds of rolled sheets. Examples are as follows: a rolled sheet of mat paper having a ratio of a transport resistance f to a transporting force F (hereinafter referred to as "f/F value") of 0.06 (represented by black triangles); a rolled sheet of mat paper having an f/F value of 0.01 (represented by white triangles); a rolled sheet of resin-coated paper having an f/F value of 0.06 (represented by black circles); and a rolled sheet of resin-coated paper having an f/F value of 0.01 (represented by white circles).

As is obvious from this figure, accurate transportation can be attained for each of the rolled sheet of mat paper having the f/F value of 0.06, the rolled sheet of mat paper having the f/F value of 0.01, and the rolled sheet of resin-coated paper having the f/F value of 0.01 because the ratio of the actual transporting amount to the designed transporting amount little decreases when the load (back tension) imposed on the rolled sheet increases.

In the rolled sheet of resin-coated paper having the f/F value of 0.06, however, the ratio of the actual transporting amount to the designed transporting amount decreases even in the case where the load (back tension) imposed on the rolled sheet is zero. As the load (back tension) imposed on the rolled sheet increases, the ratio of the actual transporting amount to the designed transporting amount decreases significantly. That is, transporting accuracy is worsened.

Figure 5B:
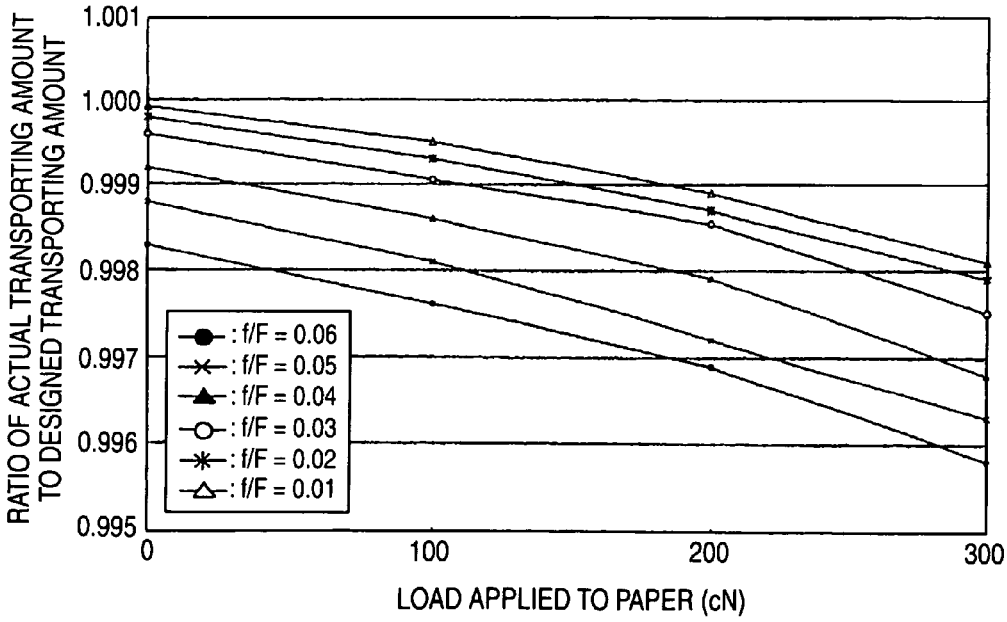
FIG. 5B is a graph showing a relation between loads imposed on the rolled sheet and transporting accuracies of a resin-coated rolled sheet, for various ratios of transport resistance to transporting force.

FIG. 5B is a graph showing a relation between ratios of an actual transporting amount to a designed transporting amount and loads (back tensions) imposed on the rolled sheet, for various f/F values. As is obvious from this figure, when the f/F value is not greater than 0.03, the rolled sheet can be transported accurately because the ratio of the actual transporting amount to the designed transporting amount little decreases though the load (back tension) imposed on the rolled sheet increases. As described above, when f/F is selected to be not greater than 0.03, more preferably, not greater than 0.01, transporting accuracy for various types of rolled sheets can be improved. Incidentally, when this rule is applied not only to the rolled sheet but also to various recording media such as a cut sheet of paper, transporting accuracy can be improved.

As a comparative example, the inner circumferential face 126*c* of the follower roller 126 was made of plastics (polyacetal) and the shaft 126*a* was made of metal (stainless steel). In this case, the friction coefficient $\mu$ was 0.155 and the ratio f/F of transport resistance f to transporting force F was 0.06. On this occasion, the outer diameter D of the follower roller 126 was 5 mm, the outer diameter d of the shaft 126*a* was 1.5 mm, and the friction coefficient $\mu'$ of the feeding roller 125 was 0.8.

Figure 4B:
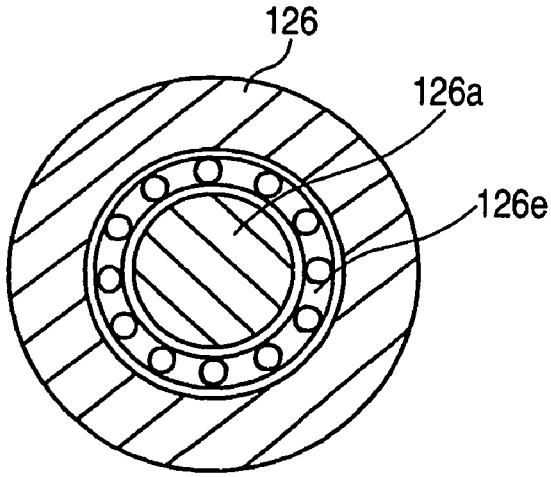
FIG. 4B is a sectional view showing the internal structure of the follower roller of FIG. 4A.

On the contrary, when a ball bearing 126*e* which was a roller bearing was disposed in an inner race of the follower roller 126 as shown in FIG. 4B, the friction coefficient $\mu$ was set at 0.025 and f/F was set at 0.01. On this occasion, the outer diameter D of the follower roller 126 was 5 mm, the outer diameter d of the shaft 126*a* was 1.5 mm, and the friction coefficient $\mu'$ of the feeding roller 125 was 0.8.

The outer diameter D of the follower roller 126 and the outer diameter d of the shaft 126*a* were changed as follows. When, for example, the follower roller 126 was formed so that the diameter D of the follower roller 126 became larger while the outer diameter d of the shaft 126*a* became smaller to reduce the friction coefficient $\mu$, the ratio f/F could be set to be in a range of from 0.02 to 0.05.

According to a further experiment, the friction coefficient $\mu$ could be set to be in a range of from 0.02 to 0.03 when a ball bearing was disposed in the shaft bearing of the shaft 126*a* of the follower roller 126, and the friction coefficient ii could be set to be in a range of from 0.12 to 0.2 when a sleeve bearing made of plastics or the like was disposed in a bearing of the shaft 126*a* of the follower roller 126. On the other hand, the friction coefficient $\mu'$ could be set to be in a range of from 0.5 to 0.9 in accordance with the material of the front surface of the feeding roller 125. When strength was considered, the lower limit of the outer diameter d of the shaft 126*a* was 0.8 mm.

Although description has been made on the case where a follower roller formed so that the ratio f/F is set to be not greater than 0.03, more preferably, not greater than 0.01 is applied to the roller 126 driven by the feeding roller 125, the invention is not limited thereto. For example, transporting accuracy can be improved when such a follower roller is applied to a pinch roller 153 which is a follower roller of a delivery roller 152 or to a follower roller 132 of an ejection roller 131.

Also in the case where the load W was changed for each of the follower rollers 126 having different friction coefficients $\mu$, there was obtained a phenomenon that the ratio of the actual transporting amount to the designed transporting amount was substantially constant when the back tension was zero. Therefore, a simulation for the phenomenon was performed on the basis of following hypotheses.

1) The back tension of zero is apparent back tension, so that the actual back tension start position is equivalent to a point minus the value of transport resistance f because of the influence of the transport resistance f.
2) To generate a constant slippage in paper transporting (the ratio of the actual transporting amount to the designed transporting amount), the back tension needs to be doubled when the load W is doubled.

Figure 6:
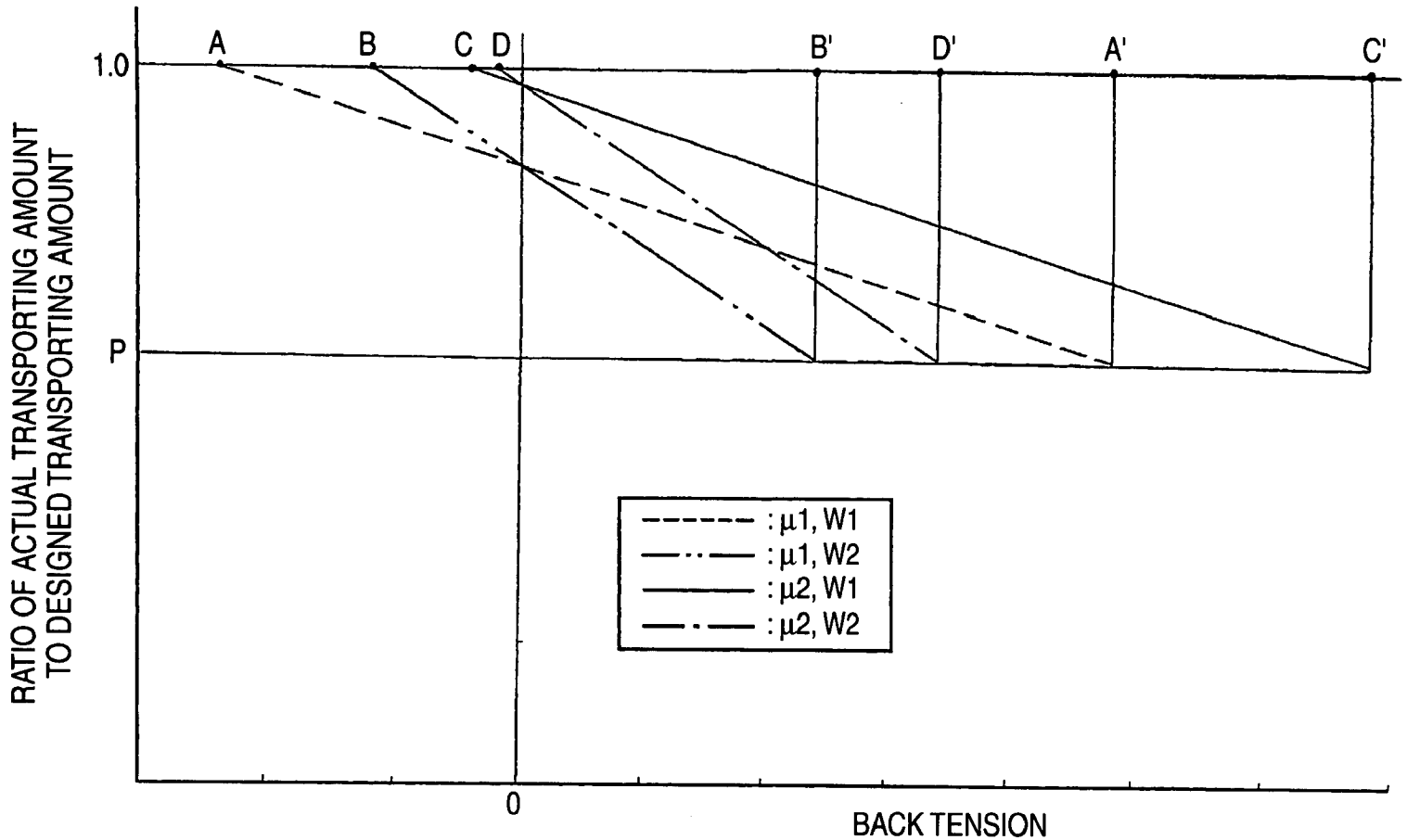
FIG. 6 is a graph showing a simulation result of a relation between back tensions and ratios of actual transporting amount to designed transporting amount, for various loads imposed follower rollers having different friction coefficients.

FIG. 6 is a graph showing the simulation result of the relation between the ratios of the actual transporting amount to the designed transporting amount and the back tensions, in cases where large and small loads W1 and W2 are applied to each of follower rollers 126 having large and small friction coefficients $\mu$1 and $\mu$2. Here, the dashed line shows the case where the large load W1 is applied to the follower roller 126 having the large friction coefficient $\mu$1, the dashed chain line shows the case where the small load W2 is applied to the follower roller 126 having the large friction coefficient $\mu$1, the solid line shows the case where the large load W1 is applied to the follower roller 126 having the small friction coefficient $\mu$2, and the chain line shows the case where the small load W2 is applied to the follower roller 126 having the small friction coefficient $\mu$2.

According to the hypothesis 1, the actual back tension start position is equivalent to a point A, B, C or D minus the value of transport resistance f because of the influence of the transport resistance f. On the other hand, to generate a constant slippage in paper transporting (the ratio of the actual transporting amount to the designed transporting amount), the back tension needs to be doubled when the load W is doubled. That is, a point A' is required for a point B', and a point C' is required for a point D'. As a result, if the friction coefficient $\mu$ is constant, the transporting amounts at the back tension of zero coincide with each other regardless of whether the load W is large or small.

Figure 7:
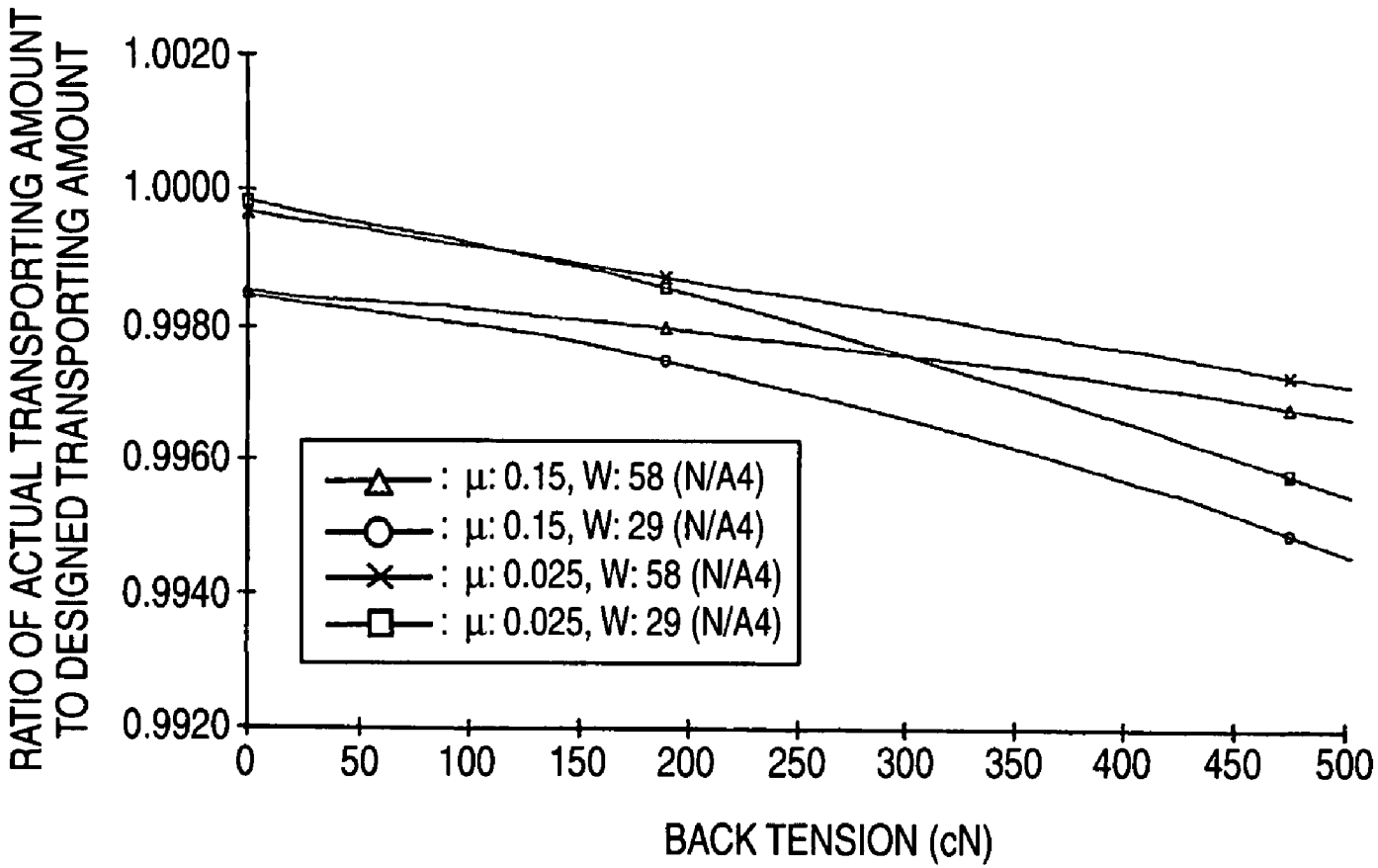
FIG. 7 is a graph showing an actual measurement result of a relation between the back tensions and the ratios of an actual transporting amount to a designed transporting amount, for various loads imposed follower rollers having different friction coefficients.

FIG. 7 is a graph showing an actual measurement result of the relation between the ratios of the actual transporting amount to the designed transporting amount and the back tensions in cases where the loads W of 29 N and 58 N are applied to each of follower rollers 126 having friction coefficients of 0.15 and 0.025. In FIG. 7, the white triangles represent the case where the load W of 58 N is applied to the follower roller 126 having the friction coefficient $\mu$ of 0.15, the white circles represent the case where the load W of 29 N is applied to the follower roller 126 having the friction coefficient $\mu$ of 0.15, the crosses represent the case where the load W of 58 N is applied to the follower roller 126 having the friction coefficient $\mu$ of 0.025, and the white rectangles represent the case where the load W of 29 N is applied to the follower roller 126 having the friction coefficient $\mu$ of 0.025.

As is obvious from this figure, the transporting amount at the back tension of zero little changes though the load W increases. It is understood that the result of actual measurement in FIG. 7 substantially coincides with the result of simulation in FIG. 6. Accordingly, when the load W is set so that the lowering of the transporting amount caused by the change of the back tension is reduced, the slippage at the time of transporting paper can be reduced more greatly regardless of the kind of paper, so that paper transporting accuracy can be improved more greatly.

As shown in FIGS. 2 and 3, the sheet ejecting section 130 has a ejection roller 131, and a follower roller 132. The ejection roller 131 and the follower roller 132 transport the rolled sheet in the primary scanning direction to eject the roller of sheet. The ejection roller 131 is driven to rotate forward and backward by driving force transmitted from a motor through the feeding roller 125. The follower roller 132 is pressed against the ejection roller 131 by an urging member such as a spring. The follower roller 132 follows the ejection roller 131 so that the follower roller 132 can rotate forward with the forward rotation of the ejection roller 131. The ejection roller 131 and the follower roller 132 feed the rolled sheet while the roller of sheet transported is held between the ejection roller 131 and the follower roller 132. As shown in FIG. 3, a cutter 133 is disposed so as to be movable both in the vertical direction and the primary scanning direction in the condition that the edge of the cutter 133 faces downward.

As shown in FIGS. 1 and 2, the leg sections 140 have two props 142 provided with moving rollers 141. The body section 110 is placed on the props 142 and screwed to upper portions of the props 142. Because the props 142 are provided with the moving rollers 141, the body section 110 which is heavy can be moved to a desired position smoothly.

As shown in FIGS. 1 and 3, the sheet feeding section 150 is disposed under the body section 110 and between the leg sections 140. The sheet feeding section 150 includes a pair of supports 151, a delivery roller 152, and a pinch roller 153. The supports 151 support opposite ends of the rolled sheet R. The delivery roller 152 and the pinch roller 153 feed the rolled sheet R. The sheet feeding section 150 further includes a pair of arms 154 to which the supports 151 are fixed and on which respective opposite ends of the delivery roller 152 and the pinch roller 153 are supported.

Figure 8:
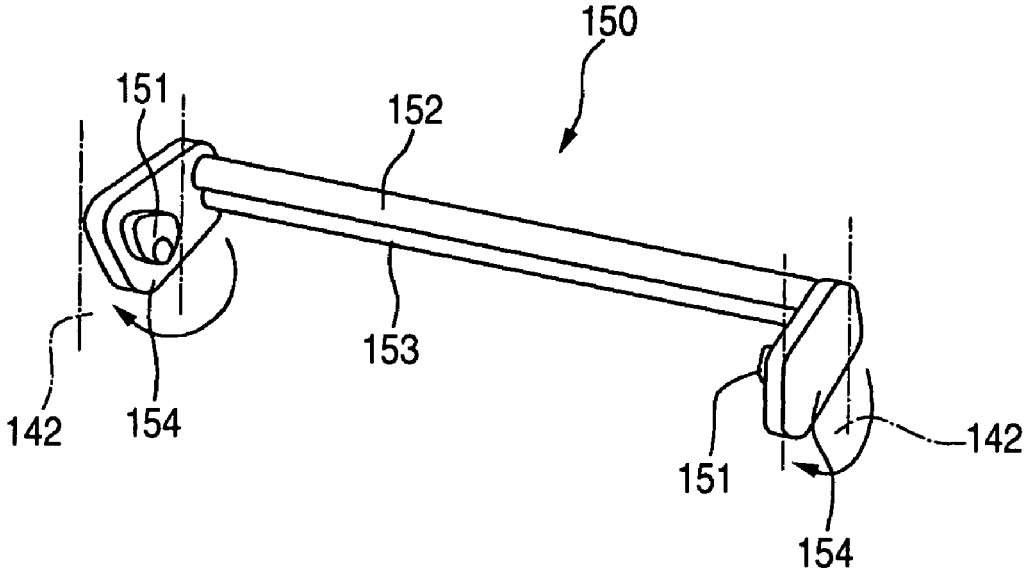
FIG. 8 is a perspective view showing the details of a sheet feeding section in the printer of in FIG. 1.
Figure 9A:
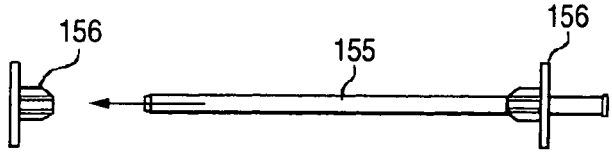
FIGS. 9A to 18 are views showing a procedure of use of the printer of FIG. 1.

As shown in FIG. 8, the pair of supports 151 are fixed and mounted onto opposed faces of the pair of arms 154 disposed opposite to each other, respectively. The pair of supports 151 have built-in bearings. As shown in FIG. 9A, a spindle 155 is inserted into an inner circumferential portion of the rolled sheet R for supporting the same. Opposite ends of the spindle 155 are rotatably supported by the bearings.

Figure 9B:
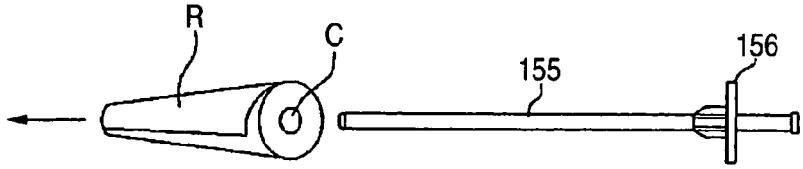
Figure 9C:
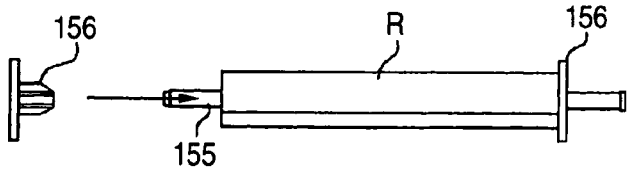

As shown in FIGS. 9B and 9C, the spindle 155 is laid between the pair of supports 151 in the condition that a pair of flange-shaped clamps 156 are fitted to opposite sides of the rolled sheet R put in the center of the spindle 155. When a user lifts the rolled sheet provided with the spindle 155 and fits the opposite ends of the spindle 155 to the pair of supports 151, mounting of the rolled sheet can be completed. Accordingly, the number of steps for setting the rolled sheet can be reduced greatly.

As shown in FIG. 8, the delivery roller 152 and the pinch roller 153 are supported to opposed faces of the pair of arms 154 respectively so that the delivery roller 152 and the pinch roller 153 can rotate in the condition that both ends of each of the delivery roller 152 and the pinch roller 153 are disposed opposite to each other. That is, the delivery roller 152 and the pinch roller 153 are disposed so as to be laid between the pair of arms 154. The two ends of the delivery roller 152 are supported at predetermined points of the opposed faces of the pair of arms 154. On the other hand, the two ends of the pinch roller 153 are supported movably, for example, in grooves provided in the opposed faces of the pair of arms 154 so that the pinch roller 153 is retractably brought into contact with the delivery roller 152. The pinch roller 153 is locked in the contact position or the retracted position of the pinch roller 153 relative to the delivery roller 152, for example, by a locking mechanism using a stopper and urging members provided in the opposed faces of the arms 154.

Because the user can easily pull out a leading end portion of the rolled sheet R by the built-in bearings of the supports 151 and can easily insert and hold the leading end portion of the rolled sheet R between the delivery roller 152 and the pinch roller 153 by the moving mechanism of the pinch roller 153, the number of steps for setting the rolled sheet R can be reduced greatly.

As shown in FIG. 8, the pair of arms 154 are attached to opposed faces of the two props 142 of the leg sections 140 respectively so that the pair of arms 154 can rotate in directions of the arrows shown in this figure. The rotation of the pair of arms 154 is locked and positioned in the replacement position shown in FIG. 10 and in the feeding position shown in FIG. 8, by a locking mechanism using a stopper and urging members provided in the opposed faces of the props 142, for example.

Figure 10:
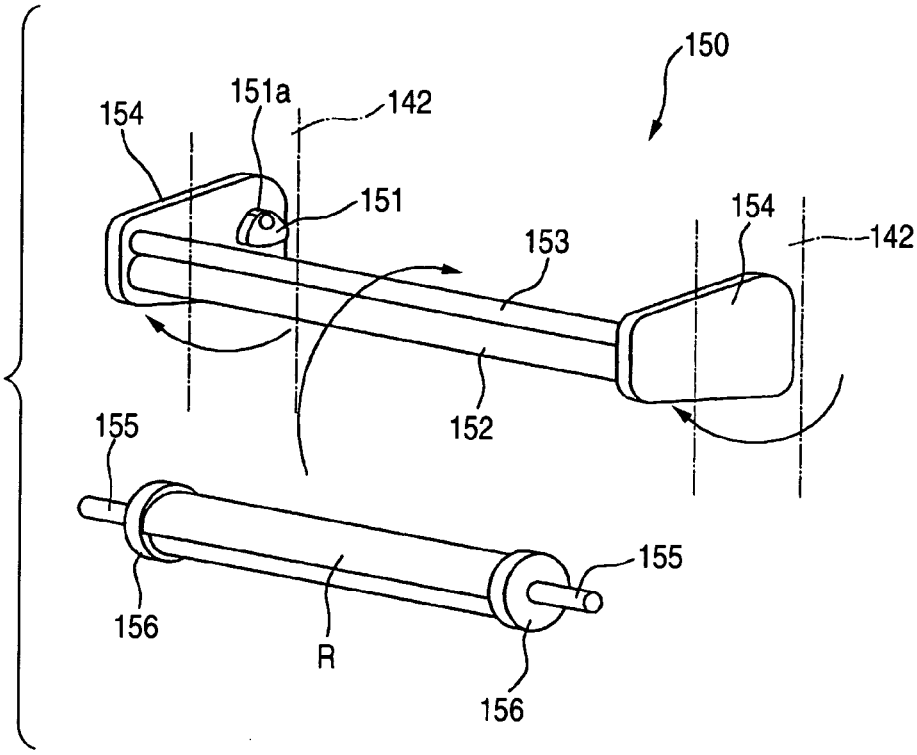

That is, the delivery roller 152 and the pinch roller 153 are provided so that the delivery roller 152 and the pinch roller 153 are protruded to the front of the ink jet printer 100 when the pair of arms 154 are rotated to the replacement position shown in FIG. 10, and that the delivery roller 152 and the pinch roller 153 are pulled into the rear of the ink jet printer 100 so as to be connected to the transporting path of the rolled sheet R when the pair of arms 154 are rotated to the feeding position shown in FIG. 8.

Because the user can operate in an ordinary place on the front side of the ink jet printer 100 without necessity of going to the rear side of the ink jet printer 100 when the leading end portion of the rolled sheet R needs to be inserted and held between the delivery roller 152 and the pinch roller 153, the number of steps for setting the rolled sheet R can be reduced greatly.

Although the aforementioned embodiment has shown the case where the pair of supports 151 are respectively fixed and mounted to the opposed faces of the pair of arms 154 disposed opposite to each other so that the supports 151 can rotate together with the arms 154, the same effect as described above can be obtained also in the case where the pair of supports 151 are fixed and mounted coaxially to rotation shafts of the arms 154 provided on the opposed faces of the two props 142 of the leg sections 140. That is, the supports 151 may be provided as supports always fixed to predetermined positions regardless of the rotation of the arms 154.

In this configuration, a procedure for using the ink jet printer 100 provided with the cutting device 210 according to the first embodiment will be described with reference to FIGS. 9A to 18. First, as shown in FIG. 9A, the user pulls one of the pair of clamps 156 fitted onto the spindle 155 out of one end of the spindle 155. Then, as shown in FIG. 9B, the user inserts the end of the spindle 155 into an axial hole C of the rolled sheet R through one end of the axial hole C.

Then, as shown in FIG. 9C, the user fits one end of the axial hole C of the rolled sheet R to the other clamp 156 fitted onto the other end of the spindle 155 so that the rolled sheet R abuts on the other clamp 156. Then, the user fits one clamp 156 to the other end of the axial hole C of the rolled sheet R through one end of the spindle 155. As a result, the rolled sheet R can rotate together with the spindle 155.

Figure 11:
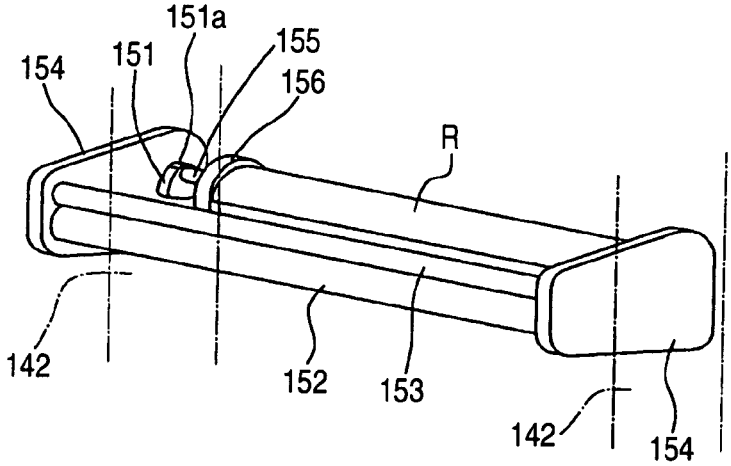

Then, for example, the user pulls the delivery roller 152 forward and pivots the arms 154 from the feeding position shown in FIG. 8 to the replacement position shown in FIG. 10. Then, the user lifts up the rolled sheet R provided with the spindle 155 from the supports 151 and fits the two end portions of the spindle 155 into grooves 151*a* of the supports 151 respectively as shown in FIG. 11. When the two ends of the spindle 155 are fitted to the pair of supports 151 respectively in this manner, mounting of the rolled sheet can be completed. Accordingly, the number of steps for setting the rolled sheet R can be reduced greatly.

Figure 12:
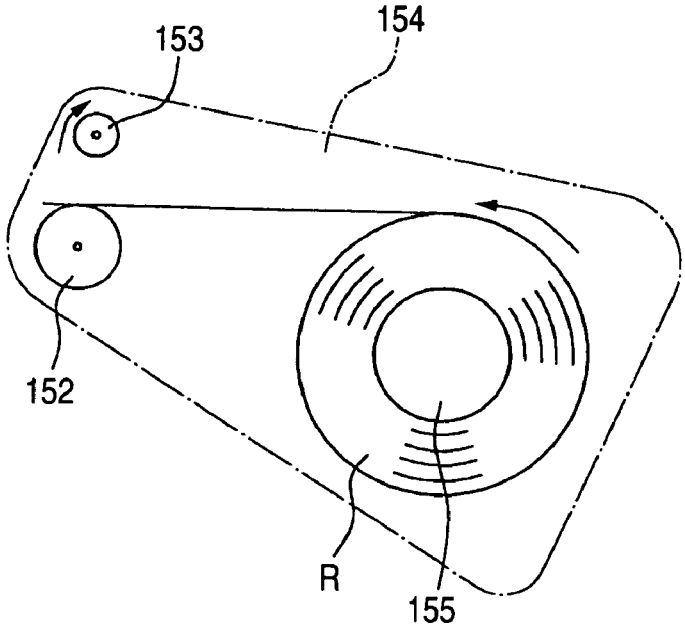
Figure 13:
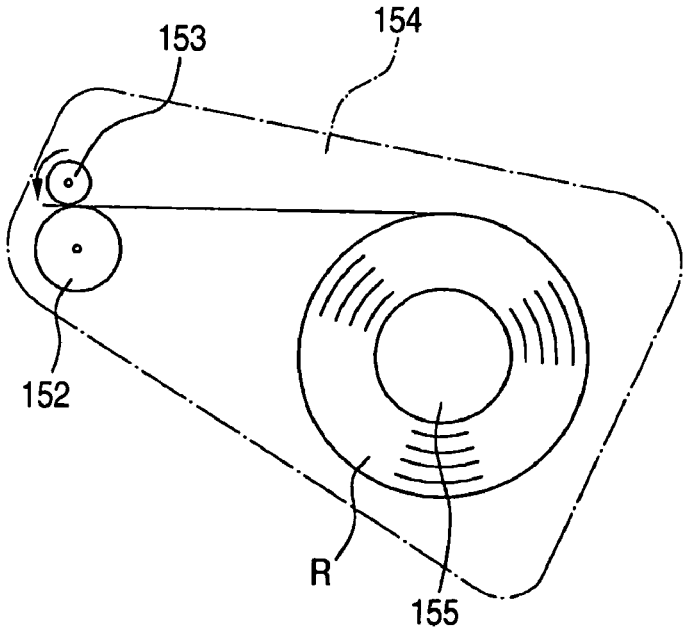

Then, as shown in FIG. 12, the user lifts the pinch roller 153 and locks the pinch roller 153 in the condition that the pinch roller 153 is retracted from the delivery roller 152. Then, the user pulls the leading end portion of the rolled sheet R forward and inserts the leading end portion of the rolled sheet R between the pinch roller 153 and the delivery roller 152. Then, as shown in FIG. 13, the user pushes down the pinch roller 153 and locks the pinch roller 153 in the contact position with respect to the delivery roller 152. As a result, the leading end portion of the rolled sheet R is held between the pinch roller 153 and the delivery roller 152. Because the user can operate in an ordinary place on the front side of the ink jet printer 100 in this manner so that the leading end portion of the rolled sheet R is pulled out and held between the delivery roller 152 and the pinch roller 153, the number of steps for setting the rolled sheet R can be reduced greatly.

Figure 14:
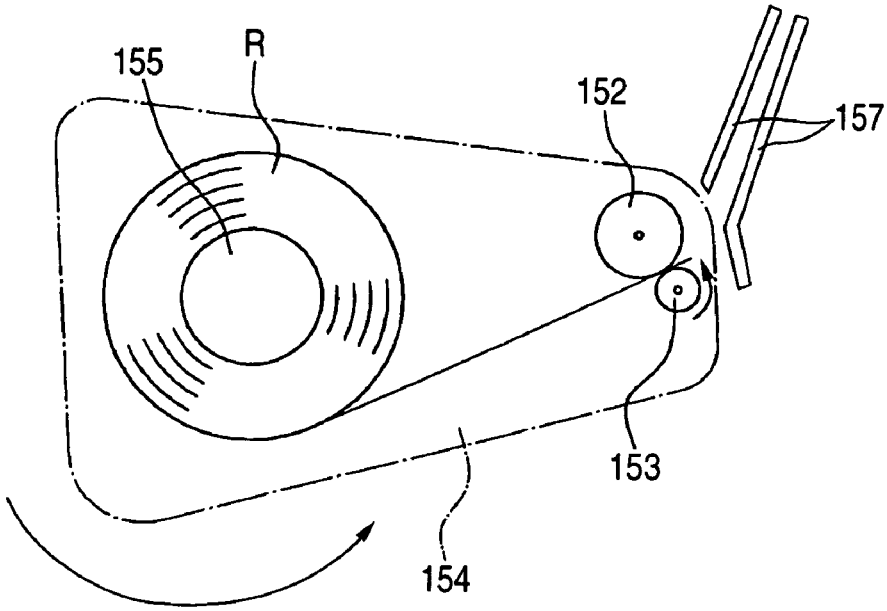

Then, for example, as shown in FIG. 14, the user pushes the delivery roller 152 backward and pivots the arms 154 from the replacement position to the feeding position. As a result, the leading end portion of the rolled sheet R held between the pinch roller 153 and the delivery roller 152 is aligned with the inlet of a feeding guide 157.

Figure 15:
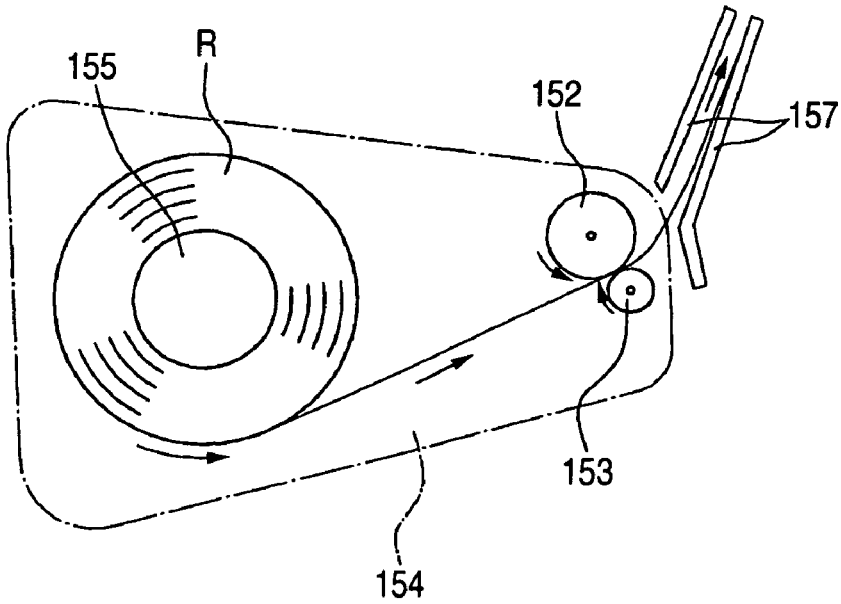
Figure 16:
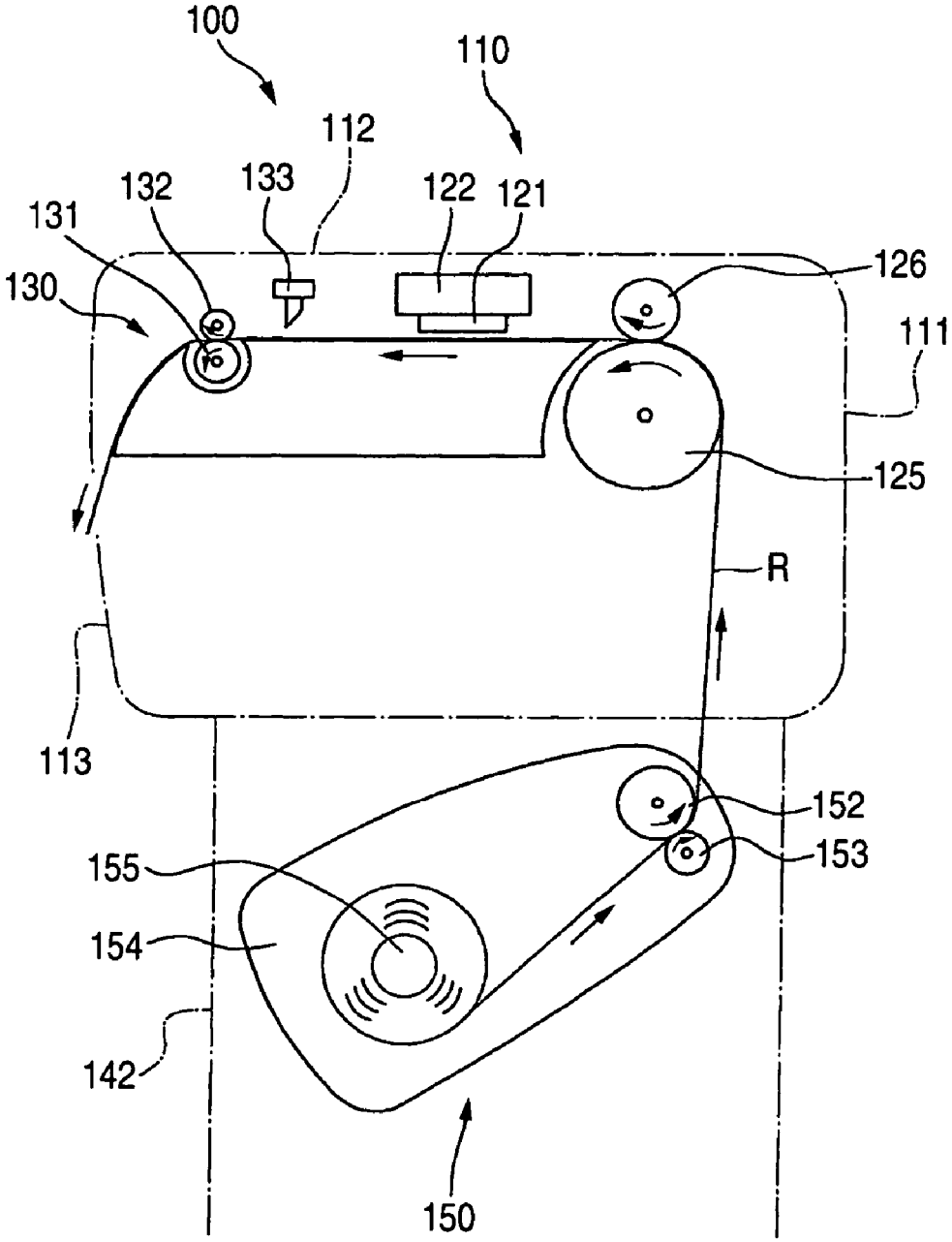

When the user operates the control panel 170 to activate the ink jet printer 100 on this occasion, the delivery roller 152 begins to rotate as shown in FIG. 15. As a result, the rolled sheet R held between the pinch roller 153 and the delivery roller 152 is guided by the feeding guide 157 and fed to the recording section 120 located above the sheet feeding section 150. Then, as shown in FIG. 16, the rolled sheet R is transported in the secondary scanning direction while the rolled sheet R is held between the feeding roller 125 and the follower roller 126 and held between the ejection roller 131 and the follower roller 132. In this condition, ink drops are jetted from the recording heads 121 moving in the primary scanning direction, so that predetermined information is recorded on the rolled sheet R. On this occasion, because the friction coefficient $\mu$ between the outer circumferential face 126*b* of the shaft 126*a* of the follower roller 126 and the inner circumferential face 126*c* of the follower roller 126 is set to be smaller, the ratio f/F of transport resistance f to transporting force F of the rolled sheet R is also reduced. Accordingly, accuracy in transporting the rolled sheet R can be improved so that accurate recording can be performed.

Figure 17:
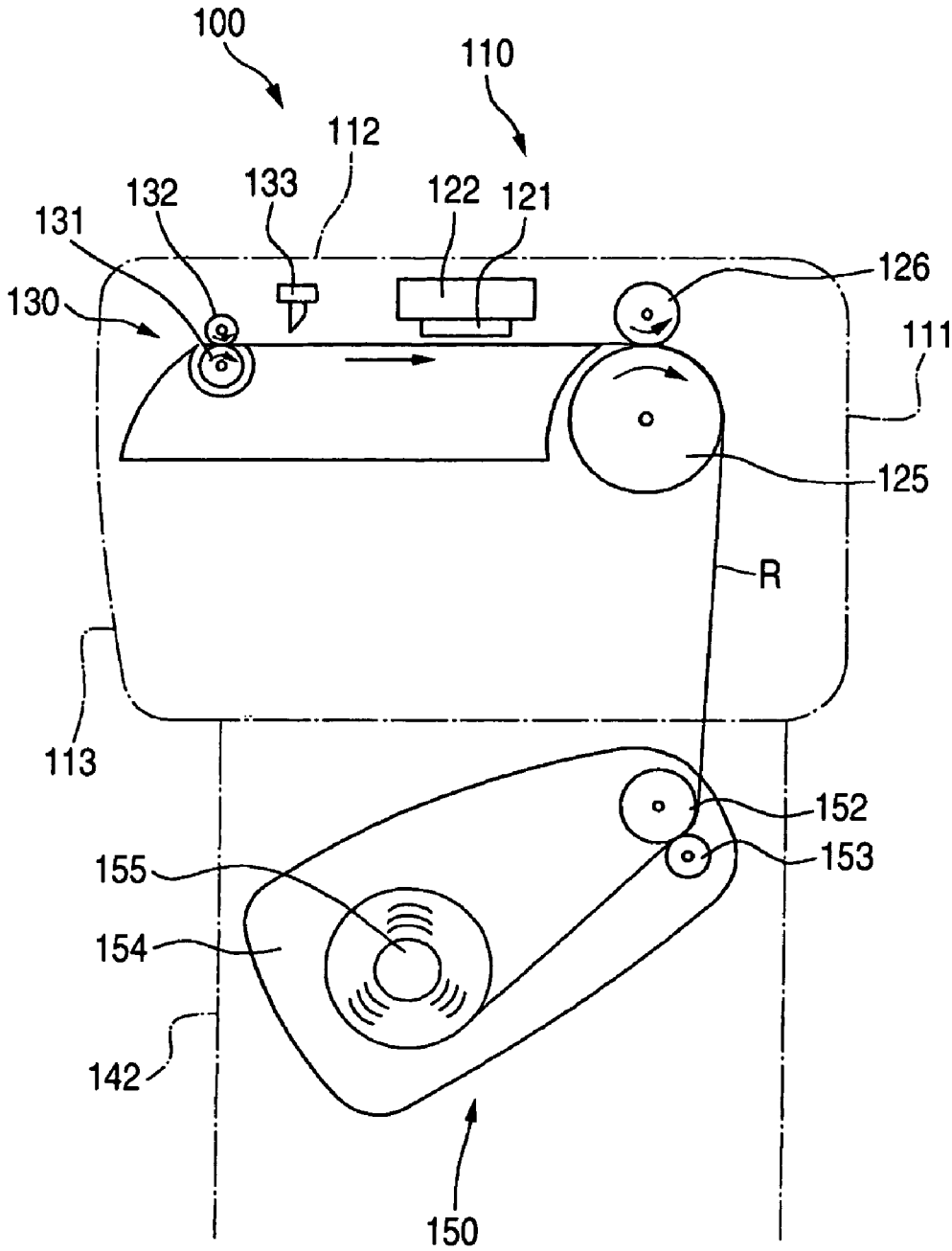
Figure 18:
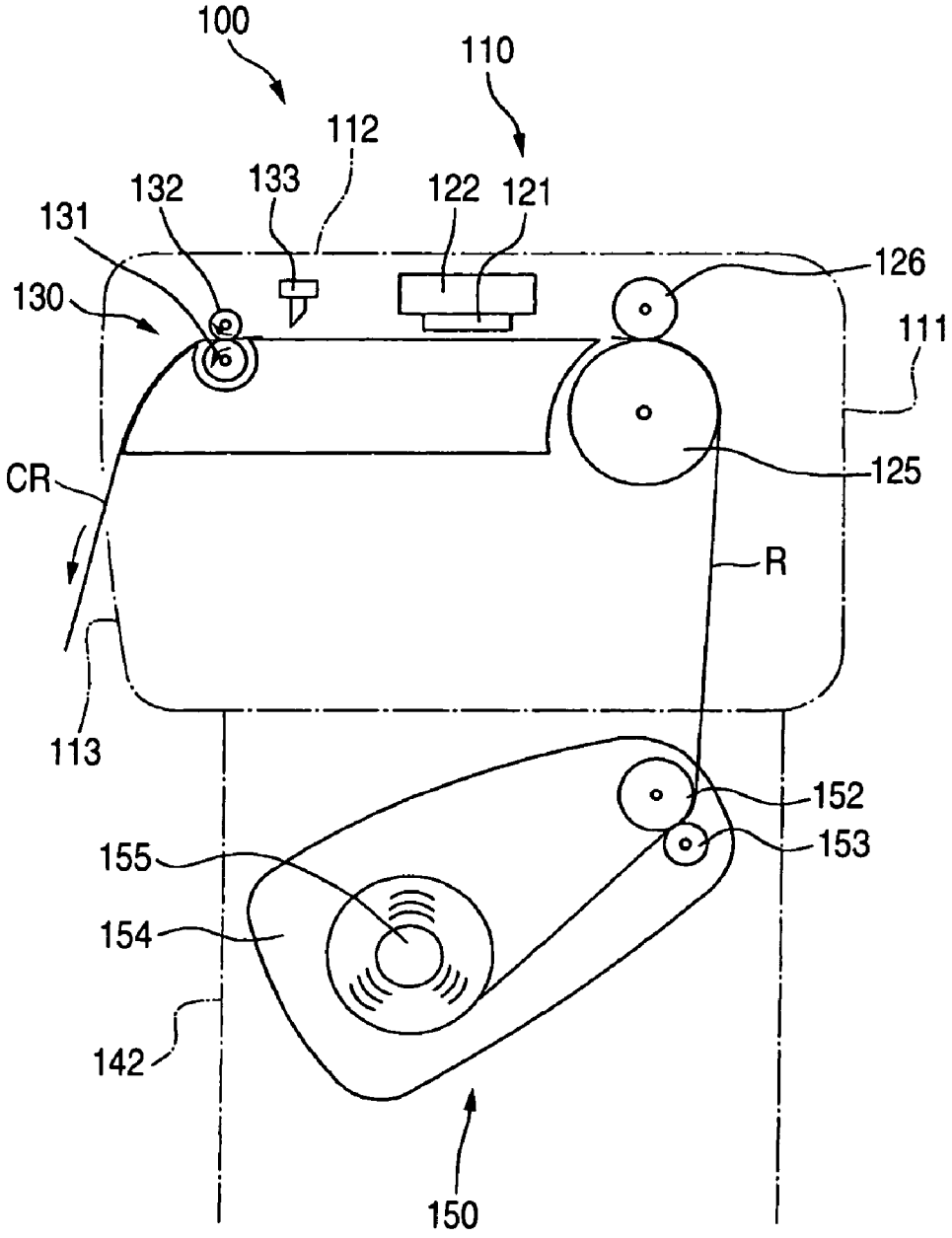

After completion of recording, as shown in FIG. 17, the rolled sheet R is transported backward by the backward rotation of the feeding roller 125 and the ejection roller 131, so that the rolled sheet R is cut both in the primary scanning direction and in the secondary scanning direction by the cutter 133. Finally, as shown in FIG. 18, the cut piece of the rolled sheet CR is ejected while clamped between the ejection roller 131 and the follower roller 132.

As described above, in the ink jet printer 100 according to this embodiment, the ratio f/F of transport resistance f based on a friction loss of the shaft 126*a* of the follower roller 126 caused by the pressing force W of the follower roller 126 to transporting force F generated on the feeding roller 125 on the basis of the pressing force W of the follower roller 126 brought into press contact with the feeding roller 125 serving as a medium transporting device is set to be not greater than 0.03. Accordingly, the transport resistance f can be reduced. Accordingly, the slippage of the rolled sheet can be reduced particularly when a rolled sheet easy to slip is transported. While accuracy in transporting the rolled sheet can be improved, roller marks can be prevented from being generated on the recording surface of the rolled sheet R.

Moreover, the pressing force of the follower roller 126, that is, the load W is set so that lowering of the roll paper transporting amount caused by the change of the load imposed on the rolled sheet is reduced. Accordingly, the slippage at the time of transporting the rolled sheet can be reduced more greatly regardless of the kind of the rolled sheet. Accuracy in transporting the rolled sheet can be improved more greatly.

Although description has been made on the case where an ink jet printer is used as the recording apparatus, the invention is not limited thereto. The invention may be applied to a recording apparatus such as a facsimile machine or a copying machine if the recording apparatus can use the transporting device. Moreover, the apparatus to which the invention can be applied is not limited to the recording apparatus if the apparatus can transport the medium. That is, the invention may be applied to any other apparatus than the recording apparatus.

What is claimed is:

1. A device for transporting a medium, comprising:

a driving roller; and a follower roller, brought into press contact with the driving roller by a load having a predetermined value, thereby being rotated in accordance with a rotation of the driving roller to transport the medium clamped therebetween in a first direction, the follower roller comprising a shaft portion and a roller body provided so as to surround the shaft portion, wherein the follower roller is configured such that a value of a ratio f/F is not greater than 0.03, where F is a force transporting the medium in the first direction which is generated by the load, and f is a resistance force generated in a second direction opposite to the first direction by a friction loss of the shaft portion of the follower roller which is generated by the load.

2. The medium transporting device as set forth in claim 1, wherein a ball bearing is disposed between the shaft portion and the roller body.

3. The medium transporting device as set forth in claim 1, wherein the value of the ratio f/F is determined by adjusting a ratio d/D, where d is an outer diameter of the shaft portion and D is an outer diameter of the follower roller.

4. The medium transporting device as set forth in claim 1, wherein the value of the load is determined so as to reduce a decrease of a transporting amount of the medium due to fluctuation of the load.

5. A recording apparatus, comprising:

the medium transporting device as set forth in claim 1; and a recording section which performs a recording operation with respect to the medium transported by the medium transporting device.

* * * * *